United States Patent [19]

Johnson, III

[11] 4,449,772

[45] May 22, 1984

[54] ELECTRICAL CONNECTOR FOR TOP AND SIDE MOUNT BATTERY TERMINALS

[75] Inventor: Thomas B. Johnson, III, St. Charles, Ill.

[73] Assignee: Cooper Industries, Inc., Houston, Tex.

[21] Appl. No.: 419,288

[22] Filed: Sep. 17, 1982

[51] Int. Cl.[3] ..... H01R 11/24; H01R 27/00

[52] U.S. Cl. ..... 339/29 B; 339/33; 339/255 P; 339/261

[58] Field of Search ..... 339/28, 29 R, 29 B, 339/32 R, 33, 224, 255 P, 261

[56] References Cited

U.S. PATENT DOCUMENTS

| | | | |
|---|---|---|---|
| 4,345,807 | 8/1982 | Shekal et al. | 339/29 B X |
| 4,373,762 | 2/1983 | Shekal et al. | 339/29 B X |
| 4,373,763 | 2/1983 | Shekal et al. | 339/29 B X |
| 4,377,317 | 3/1983 | Shekal et al. | 339/29 B X |

*Primary Examiner*—Joseph H. McGlynn
*Assistant Examiner*—Steven C. Bishop
*Attorney, Agent, or Firm*—Eddie E. Scott

[57] ABSTRACT

An electrical connector for use with top and side-mount battery terminals incorporates a fork shaped connecting surface that is adapted to fit about the tapered head portion of a side-mount automotive battery terminal bolt. The two prongs of the connector defining the fork shape are adapted to grip around the slightly tapered surface of the battery terminal bolt head. This fork element of the battery cable connector is retained in place by (1) space opposed indentions that engage the battery terminal bolt tapered head surface and (2) the opposing jaw of the battery terminal connector. The battery booster cable clamp also includes standard toothed jaws that enable the clamp to be fastened onto standard top-mount post-type battery terminals or post-type automotive battery cable terminals in the customary fashion.

5 Claims, 6 Drawing Figures

ELECTRICAL CONNECTOR FOR TOP AND SIDE MOUNT BATTERY TERMINALS

BACKGROUND OF THE INVENTION

1. Field of the Invention

The present invention relates in general to battery booster cable clamps, and more particularly to a battery booster cable clamp having the capability of use with both top-mount and side-mount terminal type batteries.

2. Description of the Prior Art

Various battery booster cable clamps are in common use today for electrically connecting two or more automotive type batteries. These battery booster cable clamps generally comprise two essentially elongate members having handles at one end thereof and electrical contacts at the other end thereof. These elongate members are pivotally connected at their midpoints to pivot in a manner to close the respective electrical contacts around a current carrying member, specifically the battery cable terminal attached to the storage battery of an automotive vehicle.

The electrical conducting or contact surfaces of these general use battery booster cable clamps comprise generally two sections adapted to clamp onto the standard top-mount battery cable terminal in order to "jump start" an automotive vehicle when that vehicle's storage battery is dead. When both the jumping and the jumped vehicles utilize standard top-mount terminal type batteries, conventional battery booster cables work quite well for their intended purpose. However, the introduction of side-mount terminal storage batteries for automotive vehicles has also introduced a problem in the ease with which these batteries may be "jump-started". Side-mount battery terminals are two-part, in that the major electrical connection is provided by (1) an essentially flat annular electrical contact surface, commonly formed as part of the battery casing, and (2) a battery terminal bolt inserted through the battery cable terminal and then threadedly inserted into this annular battery terminal surface in a manner to form a positive electrical connection between the flat annular contact surface of the battery terminal and the battery cable terminal, and between the opposite side of the battery cable terminal and the bolt head portion of the battery terminal. The battery cable terminal and two-part battery terminal are designed such that, with the battery cable attached to the battery terminal, minimal metallic surface is exposed to the atmosphere, in order to reduce the buildup of corrosive elements thereon. The negative aspect of this otherwise improved design is that it becomes rather difficult to connect a standard battery booster cable clamp to the head portion of the battery terminal bolt sufficiently to effect an electrical connection suitable for carrying the current required to start the vehicle. Additionally, inherent vibration and jostling of the automotive vehicle during the battery interconnect and engine start operations tend to snap the standard battery booster cable loose from the side-mount terminal bolt.

SUMMARY OF THE INVENTION

According to the invention, a battery booster cable clamp is adapted to be used with both top and side-mount terminal type batteries. The booster cable clamp attaches to standard top-mount battery terminals in the customary manner. One of the electrical connection jaws is provided with an open elongate slot oriented axially with the elongate clamp member. This elongate slot is adapted to fit around the shoulder portion of a battery terminal bolt head in a manner to electrically engage the bolt head and be retained in position therewith. Opposite this elongate slot on the opposing elongate jaw member is a raised portion for engaging the top surface of the battery terminal bolt when the clamp is attached to the battery terminal bolt. In this manner, the standard closing force of the booster cable clamp will cause the cable clamp to grip onto the battery terminal bolt head.

In the preferred embodiment, the open slot includes a number of space opposed indentions that permit the battery cable clamp of the present invention to be clamped onto battery terminal bolts having different head sizes.

BRIEF DESCRIPTION OF THE DRAWINGS

For a detailed description of the preferred embodiment of the invention, reference is made to the accompanying drawings, in which.

DETAILED DESCRIPTION OF THE INVENTION

Figure 1:
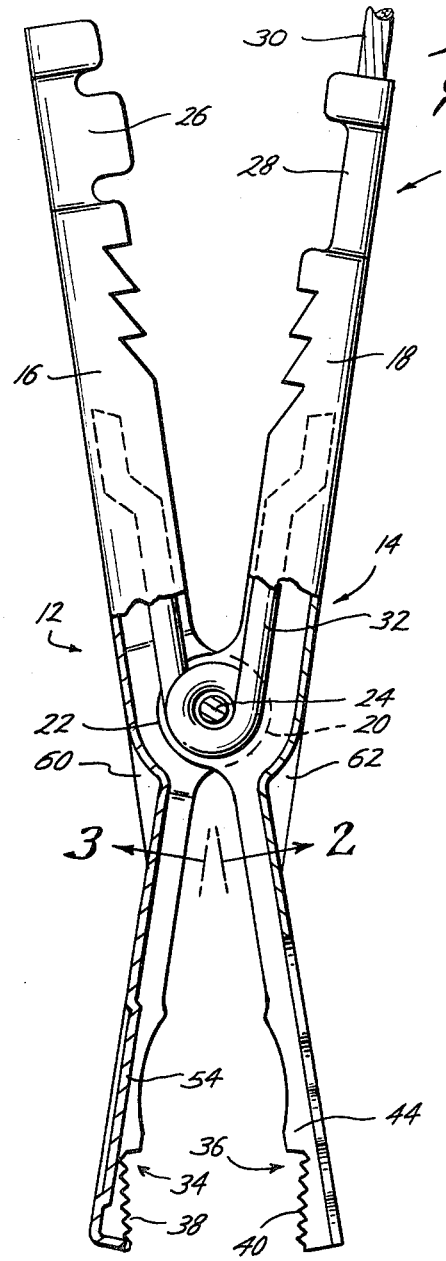
FIG. 1 is a front elevational view in partial section of the electrical connector of the present invention.

Turning now to the drawings, and more specifically to FIG. 1, an electrical connector for top and side-mount battery terminals is shown generally illustrated by the numeral 10. The electrical connector 10 generally comprises first and second essentially elongate members 12, 14, each having a handle 16, 18 at respective ends thereof for manually gripping the connector. The elongate members 12, 14 include respective pivot mount portions 20, 22, through which the members are pivotally interconnected by a pivot pin 24. A coil spring 32 is positioned around the pivot pin 24 as shown, and includes arms that extend up into respective handles 16, 18 in a manner to constantly urge the handles apart, thereby urging clamping jaws 34, 36 toward each other. Each elongate member handle 16, 18 includes a cable crimping portion 26, 28 for crimping onto an electrical cable 30. Customarily, the cable 30 is connected to only that handle and clamp elongate member having the better capability for carrying high electrical current.

Figure 6:
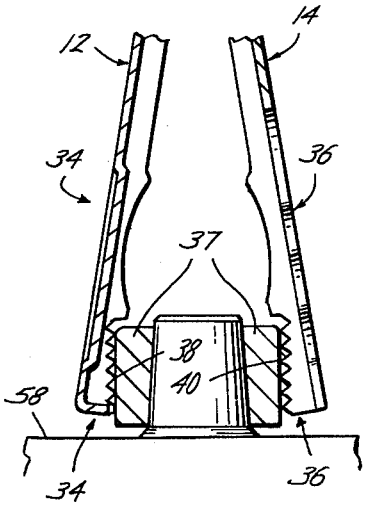
FIG. 6 is a view similar to FIG. 5, showing the electrical connector of the present invention connected to a standard top-mount battery terminal in the standard fashion.

At the ends of the first and second elongate members 12, 14 opposite the handles 16, 18 are positioned clamping jaws 34, 36, respectively. Each of these jaws 34, 36 performs a dual function. In the first functional mode, the electrical connector of the present invention is adapted to be used with a standard top-mount post type battery cable terminal 37 (see FIG. 6). To accomplish this, the clamping jaws 34, 36 include toothed contact surfaces 38, 40, respectively, for gripping onto a standard top-mount battery cable terminal in the customary manner. In the preferred embodiment, these teeth 38, 40 define planes which are inclined from the axes of the respective clamping jaws 34, 36 in order to effectively clamp onto a standard top-mount battery cable terminal uniformly along the outer surface thereof to insure an adequate electric connection therebetween, as is best shown in FIG. 6.

Figure 2:
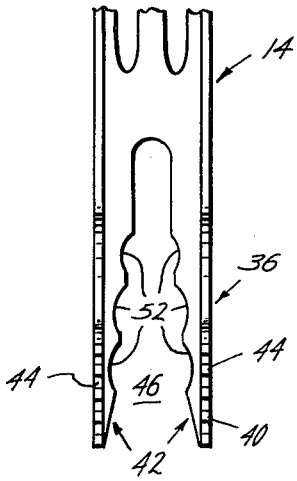
FIG. 2 is a fragmentary view of one of the clamping surfaces of the electrical connector of the present invention.

In its second mode of operation, the electrical connector of the present invention is adapted to be used with automotive vehicle batteries of the side-mount bolt-terminal type. For use in this particular application, the second elongate member clamping jaw 36 comprises a fork-shape contact surface 42 defined by two essentially elongate prongs 44. These prongs 44 define a slot 46 therebetween for receiving the shouldered head portion 48 of a side-mount battery terminal bolt 50. In the preferred embodiment, the slot 46 includes a plurality of spaced opposed indentions 52, each set of indentions defining two arcs of identical radii having the same center point. The geometric center points of these sets of indentions 52 are positioned along an imaginary centerline bisecting the elongate slot 46. Each of these sets of spaced opposed indentions 52 is of progressively decreasing radii in the direction of the closed end of the slot, as is best shown in FIG. 2. In this manner, the electrical connector of the present invention may accommodate a number of battery terminal bolt shouldered heads of various diameters, as will be explained in greater detail hereinbelow.

Figure 3:
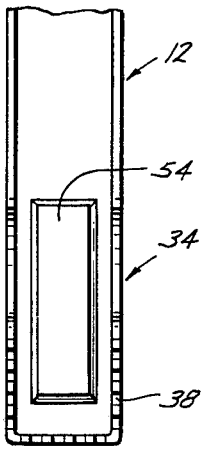
FIG. 3 is a fragmentary view of the opposing clamping surface of the electrical connector of the present invention.

As best shown in FIG. 3, the electrical connector first elongate member clamping jaw 34 includes a raised essentially flat portion 54 for engaging the top surface of the side-mount battery terminal bolt head 48 when the electrical connector 10 is in position with the fork-shape contact surface 42 in electrical contact position with the shouldered bolt head 48. In this manner, the coil spring 32 urges the raised flat portion 54 of the clamping jaw 34 toward the fork-shape contact surface 42 of the second clamping jaw 36 to clamp into the battery terminal bolt head.

Figure 4:
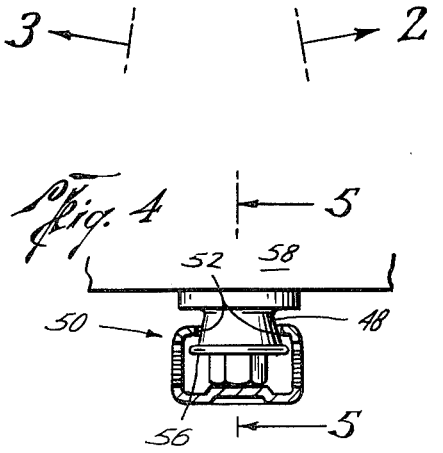
FIG. 4 is a transverse sectional view of the electrical connector of the present invention as it is affixed to a side-mount battery terminal bolt.
Figure 5:
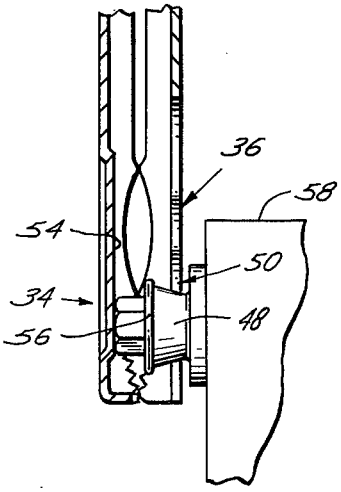
FIG. 5 is a partial vertical sectional view of the electrical connector of the present invention as it is affixed to a side-mount battery terminal bolt.

As best shown in FIGS. 4 and 5, the shouldered head portion 48 of the standard side-mount battery terminal bolt 50 is tapered slightly, being larger at the outer end and smaller at the end nearest the battery 58. The electrical connector of the present invention makes quite good use of this taper by slightly angling the contact surface of the spaced opposed indentions 52 to conform with the taper of the bolt head 48 to establish a superior electrical contact therebetween. In this manner, the contact between the tapered bolt head 48 and the fork-shape contact surface 42 is a surface contact across the entire thickness of the material forming the clamping jaw 36 and all along the pair of arcs defined by the appropriate spaced opposed indention 52. Additionally, due partially to this taper of the bolt head 48 and partially to the provision of a plurality of spaced opposed indentions 52 formed in the fork-shape contact surface 42 of the clamping jaw 36, the electrical connector 10 of the present invention will accommodate all standard side-mount battery terminal bolts currently in the marketplace.

The electrical connector 10 of the present invention is specifically designed to reach into space restricted areas adjacent side-mount terminal type batteries used in the new generation of smaller, more compact automotive vehicles. In this regard, in order to maintain the structural integrity of the elongate members 12, 14, structural bosses 60, 62 are formed in the elongate members to ensure that the full benefit of the spring energy is transmitted to the clamping jaws 34, 36.

In the electrical connector 10 of the present invention, the electrical conducting cable 30 is affixed to the second elongate member handle 18 at the crimping portion 28. Customarily, the cable 30 is connected to what is called the current carrying member of the connector. In the present invention, it has been determined that the second elongate member 14 is the better current conducting member by virtue of the fork-shape contact surface 42 having the spaced opposed identions 52 for fitting about the side-mount battery terminal shouldered bolt head 48. Therefore, the cable is connected to this member. Obviously, the cable 30 could be connected to the first elongate member 12 without departing from the spirit of the present invention.

OPERATION

In operation, the user grasps the electrical connector 10 by the first and second handles 16, 18, and squeezes them together against the action of the coil spring 32 to open the clamping jaws 34, 36. With the clamping jaws opened slightly, the operator positions the fork-shape contact surface open slot 46 downwardly and slips it over the side-mount battery terminal shouldered bolt head 48. Since the shouldered head 48 is tapered slightly, if the operator urges the clamping jaw 36 in the direction of the battery 58 (to the right in FIG. 5) so that the back side of the clamping jaw 36 engages the battery surface, and the slot 46 slips around the smallest diameter portion of the bolt head 48 as he lowers the fork-shape contact around the bolt head, positioning of the electrical connector 10 is made quite simple and easy.

When the open slot 46 is positioned downwardly about the bolt head 48 as far as possible, the operator may next reverse the direction of the urging force he is manually applying to the electrical connector 10. I.e. he next urges the clamping jaw 36 away from the battery, toward the annular ridge 56 of the terminal bolt head 48. In so doing, the appropriate set of spaced opposed indentions 52 in the fork-shape contact surface 42 center around and adjust to the tapered shouldered bolt head 48 in a manner to provide optimum electrical contact therebetween. With the fork-shape contact surface 42 therepositioned, the operator then releases the manual force opposing the coil spring 32, permitting the essentially flat raised portion 54 of the clamping jaw 34 to come to rest against the top surface of the side-mount battery terminal bolt 50, thereby retaining the electrical connector 10 in contact therewith. So positioned, the electrical connector of the present invention is in electrical contact with the battery terminal bolt head 48 at three locations, each of which provides a surface-to-surface contact therebetween, as opposed to a point-to-surface contact, as in standard toothed booster cable clamps. Specifically, the electrical connection is made by both of the spaced opposed indentions 52 at the location they engage the tapered bolt head 48, and also along the top surface of the battery terminal bolt head at its point of contact with the raised flat contact portion 54, to ensure a superior electrical connection therebetween.

Those skilled in the art will readily appreciate that due to the arc shape of the spaced opposed indentions 52, once the fork-shape contact surface 42 is in position about the shouldered terminal bolt head 48 it will remain in such position and not vibrate off or be jarred off during the customary vibration and jostling of the battery booster cables during the "jump start" operation.

To remove the electrical connector 10 from the side-mount battery terminal bolt 50, the above process is simply reversed. Specifically, the electrical connector handles 16, 18 are manually gripped and squeezed together to open the clamping jaws 34, 36 slightly. With the clamping jaws so opened, the operator urges the clamping jaw 36 having the fork-shape contact surface 42 toward the battery side of the terminal bolt 50 to release the clamping surface therefrom. At this point, a slight rotation of the electrical connector in a plane normal to the axis of the battery terminal bolt will aid in breaking this connection between the bolt head 48 and the fork-shape contact surface 42. Once this connection is broken, the electrical connector 10 is simply withdrawn from its position about the battery terminal bolt head 48.

The electrical connector of the present invention also includes a pair of opposed toothed contact surfaces 36, 38 for clamping onto a standard top-mount post-type battery cable terminal in the manner commonly known to those skilled in the art. In this regard, the electrical connector of the present invention may be used with either or both the standard top-mount post-type battery terminals or side-mount bolt-type battery terminals with equal effectiveness.

Although particular embodiments of the invention have been illustrated in the accompanying drawings and description in the foregoing Detailed Description of the Invention, it will be understood that the invention is not limited to the embodiments disclosed, but is intended to embrace any alternative, modifications, rearrangements and/or substitutions of elements as fall within the scope of the invention.

What is claimed is:

1. An electrical connector for top and side-mount battery terminals, comprising:

(a) a first member having a jaw for engaging a top-mount battery terminal and a terminal engaging surface for engaging the top of a side-mount battery terminal bolt head;

(b) a second member pivotally mounted with said first member having a jaw for engaging a top-mount battery terminal and two spaced prongs defining an open slot therebetween for receiving and electrically engaging the shoulder of a side-mount battery terminal bolt head; and (c) spring means for biasing said first and second members to pivot toward each other for mutually clamping engagement about a current carrying member.

2. An electrical connector as set forth in claim 1, wherein said slot includes a plurality of spaced opposed indentions for receiving battery terminal bolt heads of different sizes.

3. An electrical connector as set forth in claim 1, wherein said first and second member jaws are angled for providing positive electrical contact along the outer surface of a top-mount battery terminal clamp.

4. An electrical connector as set forth in claim 3, wherein said first and second member jaws include respective roughened surfaces for gripping the top-mount battery terminal clamps.

5. An electrical connector as set forth in claim 4, wherein said roughened surfaces comprise a series of teeth or serrations defining respective essentially planer surfaces.

* * * * *